United States Patent [19]

Morita

[11] 4,328,781

[45] May 11, 1982

[54] EXHAUST GAS RECIRCULATING PASSAGE ARRANGEMENT FOR CROSS-FLOW TYPE INTERNAL COMBUSTION ENGINES

[75] Inventor: Yasuyuki Morita, Hiroshima, Japan

[73] Assignee: Toyo Kogyo Co., Ltd., Hiroshima, Japan

[21] Appl. No.: 173,435

[22] Filed: Jul. 29, 1980

[30] Foreign Application Priority Data

Jul. 30, 1979 [JP] Japan ..... 54/105911[U]

[51] Int. Cl.[3] ..... F02M 25/06

[52] U.S. Cl. ..... 123/570; 123/52 M; 123/568

[58] Field of Search ..... 123/568, 570, 52 M

[56] References Cited

U.S. PATENT DOCUMENTS

| | | | |
|---|---|---|---|
| 3,237,615 | 3/1966 | Daigh | 123/570 |
| 3,937,194 | 2/1978 | Tamaki et al. | 123/568 |
| 4,072,133 | 2/1978 | McWhirter | 123/568 |
| 4,221,203 | 9/1980 | Hayashi et al. | 123/568 |

FOREIGN PATENT DOCUMENTS

| | | | |
|---|---|---|---|
| 51-143128 | 12/1976 | Japan . | |
| 52-47704 | 4/1977 | Japan | 123/568 |
| 52-59205 | 5/1977 | Japan | 123/568 |
| 53-12919 | 2/1978 | Japan . | |
| 55-43254 | 3/1980 | Japan | 123/568 |
| 55-51921 | 4/1980 | Japan | 123/568 |

*Primary Examiner*—Wendell E. Burns

*Attorney, Agent, or Firm*—Fleit & Jacobson

[57] ABSTRACT

A cross-flow type internal combustion engine having an exhaust gas recirculating passage formed in the cylinder head. The passage is located adjacent to cooling water jackets so that the gas in the passage is cooled by the water in the jackets. The passage is formed with an expansion chamber which is also located adjacent to the cooling water jackets and the intake ports. Due to the cooling effect in the passage, water content in the recirculated gas is condensed and separated from the gas. Further, the gas flow speed is decreased in the expansion chamber so that carbon particles in the recirculated gas can be separated therefrom.

7 Claims, 6 Drawing Figures

EXHAUST GAS RECIRCULATING PASSAGE ARRANGEMENT FOR CROSS-FLOW TYPE INTERNAL COMBUSTION ENGINES

The present invention relates to cross-flow type internal combustion engines and more particularly to exhaust gas recirculating means for such engines.

Exhaust gas recirculating means is provided for drawing a portion of the exhaust gas from the engine exhaust system and directing it to the engine intake system and generally includes a recirculating pipe which has one end opened to the exhaust system for example at the exhaust manifold and the other end opened to the intake system for example at the carburetor. Flow control valve means is provided in the recirculating pipe. In case of cross-flow type engines in which intake ports are formed at one side of the cylinder head and exhaust ports at the other side, however, inconveniences have been encountered in that the recirculating pipe has to be arranged so as to cross over or extend around the cylinder head. Thus, the recirculating pipe must be of a substantial length and moreover care must be taken in determining the position of the pipe because the recirculating gas in the pipe is as hot as 600° to 700° C. Further, the recirculating pipe must be of an expensive heat resistant type. Problems have also been encountered in the life and reliability of the flow control valve in the recirculating pipe because such valve is subjected to a high temperature applied by the exhaust gas in the pipe.

In Japanese patent application No. 50-67251 which has been filed on June 3, 1975 and disclosed for public inspection on Dec. 9, 1976 under the disclosure number of 51-143128, and Japanese utility model application No. 51-93835 which has been filed on July 16, 1976 and disclosed for public inspection under the disclosure number of 53-12919, there are disclosed cross-flow type engines having cylinder heads formed with exhaust gas recirculating passages. In these known engines, however, there are further problems in that carbon particles and water vapors are introduced together with the exhaust gas into the intake system and that pulsations are produced in the flow of exhaust gas in the recirculating passage.

It is therefore an object of the present invention to provide exhaust gas recirculating means for cross-flow type engines, which do not include recirculating pipes of substantial lengths.

A further object of the present invention is to provide exhaust gas recirculating means which has means for separating carbon particles and water vapors from the recirculated exhaust gas.

Another object of the present invention is to provide exhaust gas recirculating means in which means is provided for eliminating pulsations of the flow of the recirculated exhaust gas.

Still further object of the present invention is to provide exhaust gas recirculating means having means for cooling the recirculated exhaust gas.

According to the present invention, the above and other objects can be accomplished by a cross-flow type internal combustion engine including cylinder block means having cylinder bore means, cylinder head means mounted on the cylinder block means to define combustion chamber means therein, intake port means formed in said cylinder head means at one side thereof and opening at one end to said combustion chamber means, exhaust port means formed in said cylinder head means at the other side thereof and opening to said combustion chamber means, said cylinder head means being formed with mating surface means where the other end of the intake port means is opened, intake manifold means attached to said cylinder head means and communicating with said intake port means, cooling medium jacket means formed in said cylinder head means for passing cooling medium therethrough, exhaust gas recirculating passage means formed in said cylinder head means adjacent to said intake port means and said jacket means, said exhaust gas recirculating passage means having one end opened to said exhaust port means and the other end opened at said mating surface means, expansion chamber means formed in said exhaust gas recirculating passage means adjacent to said intake port means and said jacket means.

According to the features of the present invention, the flow speed of the recirculated exhaust gas is decreased at the expansion chamber means so that the carbon particles carried therein can effectively be separated. Further, since the expansion chamber is located adjacent to the cooling medium jacket means, the recirculated gas is cooled and water vapor contained therein is condensed. Such condensed water may be separated from the gas flow by any suitable means. Carbon particles may be deposited on the cooled wall surface of the expansion chamber means.

Where the present invention is applied to a multiple cylinder engine having a plurality of intake ports, the expansion chamber means may preferably be formed between two adjacent intake ports. Since the area around the intake ports is of less thermal input as compared with the other parts in the cylinder head, it is relatively easy to find a space for the expansion chamber. However, beneath the intake ports, there are formed cooling medium jackets so that it is preferable to provide such expansion chamber between two adjacent intake ports. This arrangement is preferable in that the expansion chamber can be provided without increasing the overall height of the cylinder head. It is further preferable to open the recirculating passage means to at least two exhaust ports to thereby decrease or suppress the pulsations in the gas flow. In such an instance, it is recommendable that the recirculating passage be opened to the exhaust ports leading from the combustion chambers where combustion does not take place in succession in order to avoid interference between exhaust gas flows in the exhaust ports.

The above and other objects and features of the present invention will become apparent from the following descriptions of preferred embodiments taking reference to the accompanying drawings, in which.

Figure 1:
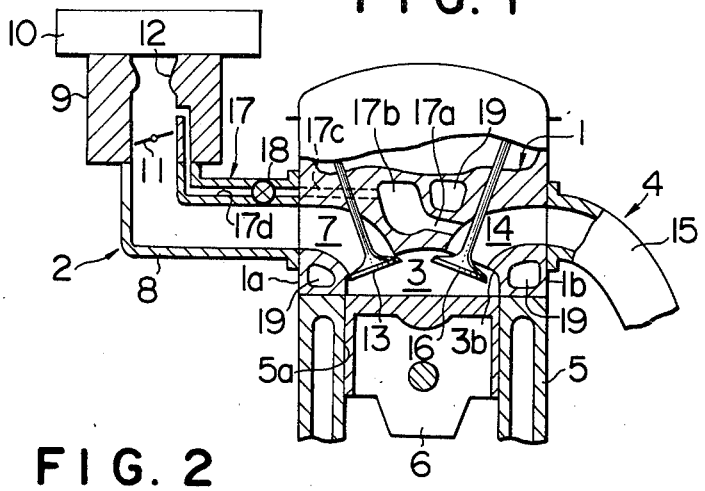
FIG. 1 is a vertical sectional view of an engine in accordance with one embodiment of the present invention.

Referring now to the drawings, particularly to FIG. 1, there is shown an engine including a cylinder block 5 attached with a cylinder head 1. In this example, the cylinder block 5 is formed with four linearly aligned cylinder bores 5*a* although only one is shown in FIG. 1. The cylinder head 1 is formed with recesses 3*a* which correspond to the cylinder bores 5*a* respectively to define combustion chamber 3. In each of the cylinder bores 5*a*, there is disposed a piston 6 which reciprocates in the cylinder bores 5*a*. The engine includes an intake system 2 for supplying the combustion chamber 3 with combustible mixture and an exhaust system for exhausting combustion gas from the combustion chamber 3. The engine is of a cross-flow type in which the intake system 2 is located opposite to the exhaust system with respect to the combustion chamber 3.

The intake system 2 includes an intake port 7 formed in the cylinder head 1 and having one end opened to the combustion chamber 3. The cylinder head 1 is formed at the side adjacent to the intake port 7 with a mating surface 1*a* and at the opposite side with a mating surface 1*b*. The intake port 7 is opened at the other end to the mating surface 1*a* and communicated with an intake manifold 8 which is attached to the cylinder head 1 at the mating surface 1*a*. The intake manifold is connected at the upstream end with a carburetor 9 which is in turn connected with an air cleaner 10 and includes a throttle valve 11 and a venturi 12. An intake valve 13 is associated with the intake port 7.

The exhaust system 4 includes an exhaust port 14 having one end opened to the combustion chamber 3 and the other end opened to the mating surface 1*b*. An exhaust manifold 15 is attached to the cylinder head 1 at the mating surface 1*b* and communicated with the exhaust port 14. The exhaust port 14 is associated with an exhaust valve 16.

In the cylinder head 1, there are formed cooling water jackets 19. Further, the engine is also formed with an exhaust gas recirculating passage 17 for directing a portion of the exhaust gas to the intake system 2. The passage 17 includes inlet ports 17*a* which are formed in the cylinder head 1 and open to respective ones of the exhaust ports 14, an intermediate passage portion 17*b* formed in the cylinder head 1 and leading from the inlet ports 17*a*, and an outlet port 17*c* which is opened at one end to the passage portion 17*b* and at the other end to the mating surface 1*a*. The intake manifold 8 is formed with a passage 17*d* which is at one end communicated with the outlet port 17*c* in the cylinder head 1 and at the other end with the intake passage upstream of the throttle valve 11 in the carburetor 9. In the passage 17*d*, there is provided a flow control valve 18 which controls the flow of the recirculated gas through the passage 17*d*.

Figure 2:
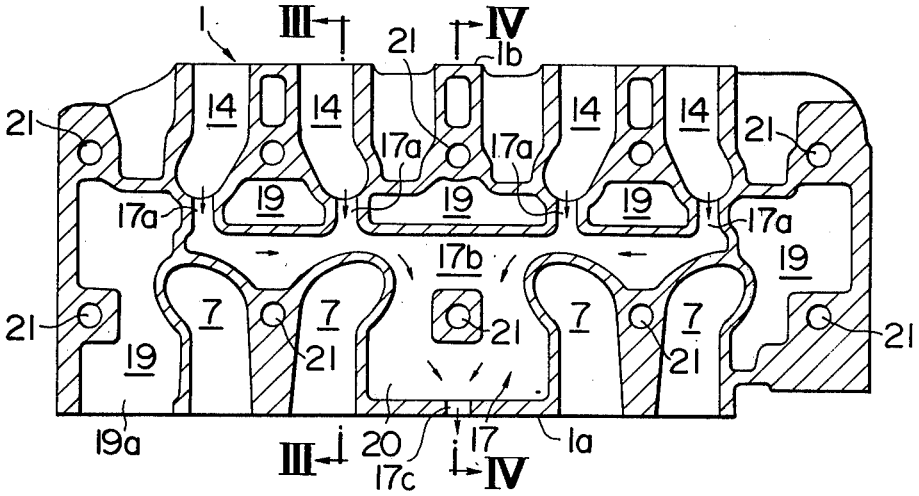
FIG. 2 is a horizontal sectional view of the cylinder head in the engine shown in FIG. 1.
Figure 3:
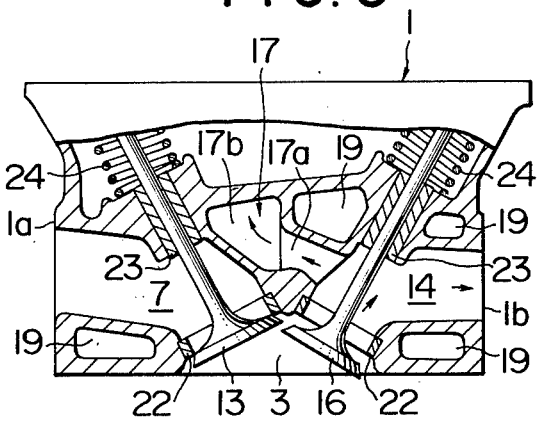
FIG. 3 is a sectional view taken substantially along the line III—III in FIG. 2.
Figure 4:
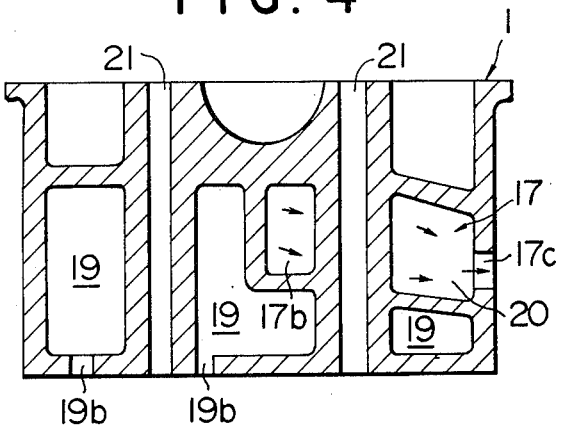
FIG. 4 is a sectional view taken substantially along the line IV—IV in FIG. 2.

Referring to FIGS. 2 through 4, it will be noted that the intermediate passage portion 17*b* extends along the length of the cylinder head 1 and is located adjacent to the water jackets 19. Further, the intermediate passage portion 17*b* is formed with an expansion chamber 20 which is located between two adjacent intake ports 7. The outlet port 17*c* is then opened to the expansion chamber 20. As shown in FIGS. 3 and 4, water jackets 19 are formed along the length of the cylinder head 1 and extend beneath the intake and exhaust ports 7 and 14. The water jackets 19 in the cylinder head 1 has an outlet 19*a* and a plurality of inlets 19*b* which a connected with water jackets 19 formed in the cylinder block 5. In FIG. 4, it will be noted that the intermediate passage portion 17*b* and the expansion chamber 20 therein are formed above the water jackets 19 extending beneath the intake ports 7.

In FIGS. 2 and 4, there are further shown bolt holes 21 for passing connecting bolts which secures the cylinder head 1 to the cylinder block 5. FIG. 3 further shows valve seats 22, valve guides 23 and valve springs 24 for the intake and exhaust valves 13 and 16.

In the illustrated arrangement, a portion of the exhaust gas in the exhaust ports 14 is drawn through the inlet ports 17*a* into the intermediate passage portion 17*b* and the expansion chamber 20 formed therein. In the passage portion 17*b*, the exhaust gas is cooled by the cooling medium in the jackets 19 and the flow speed of the recirculated exhaust gas is decreased at the expansion chamber 20. It will thus be understood that water vapor and carbon particles in the recirculated gas are separated and deposited on the wall surfaces of the intermediate passage portion 17*b*. It should be noted that the temperature of the recirculated gas can be decreased as low as 200° to 400° C. at the outlet port 17*c*.

In the arrangement shown in FIG. 1, the passage 17*d* is opened to the intake passage in the carburetor 9 between the throttle valve 11 and the venturi 12, however, it may be opened at any position, for example, upstream of the venturi or downstream of the throttle valve 11. Where the exhaust recirculating passage is opened upstream of the venturi 12, it is possible to eliminate any effect on the overall mixing ratio of the intake gas since a portion of the intake air is simply substituted by the recirculated gas. Where the exhaust recirculating passage is opened between the throttle valve 11 and the venturi 12, it is possible to control the amount of the recirculated gas in accordance with the amount of the intake mixture. However, in either of the above arrangements, disadvantages may be encountered in that foreign particles such as carbon particles which may be carried by the recirculated gas may cause clogging of ports and nozzles in the carburetor. Further, water vapor which may be contained in the recirculated gas may cause icing of the carburetor in winter time.

According to the present invention, however, the exhaust gas recirculating passage 17 has an intermediate passage portion 17*b* which is provided with an expansion chamber 20, so that the flow speed of the recirculated gas is decreased to such an extent that the carbon particles are separated from the gas. Further, the intermediate passage portion 17*b* is so arranged that the gas therein can be effectively cooled. It will therefore be understood that water vapor in the gas is condensed and deposited on the wall surfaces of the passage portion 17*b*. Thus, according to the present invention, the recirculated gas can be discharged upstream of the throttle valve without producing any problems due to the carbon particles and water vapor contained therein. The passage 17*d* may not necessarily be formed in the intake manifold 8 but may be substituted by a pipe.

Figure 5:
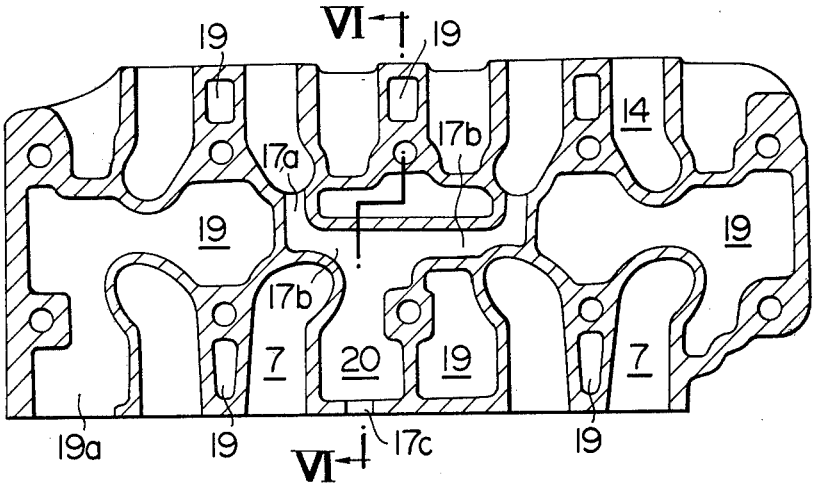
FIG. 5 is a sectional view similar to FIG. 2 but showing another embodiment; and, FIG. 6 is a sectional view taken substantially along the line VI—VI in FIG. 5.
Figure 6:
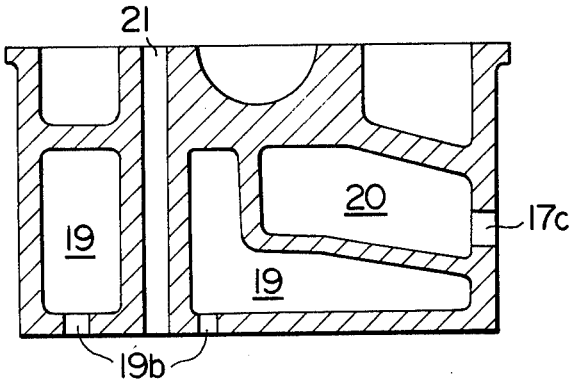

Referring now to FIGS. 5 and 6, the embodiment shown therein is substantially the same as the previous embodiment so that corresponding parts are designated by the same references as in the previous embodiment. In the embodiment shown in FIGS. 5 and 6, the inlet ports 17*a* are formed only in the exhaust ports 14 leading from Nos. 2 and 3 cylinders. Since the combustion does not take place successively in the Nos. 2 and 3 cylinders, it is possible to eliminate interference between exhaust gases in the exhaust ports 14. Alternatively, the outlet ports 17*a* may be formed in the exhaust ports 14 leading from the Nos. 1 and 4 cylinders. In such an arrangement, it is possible to provide an intermediate passage portion of an increased length so that separation of water vapor and carbon particles can be enhanced. The illustrated embodiments provide further advantages in that the intake mixture in the intake ports 7 is preheated by the recirculated exhaust gas in the passage portion 17*b*.

The invention has thus been shown and described with reference to specific embodiments, however, it should be noted that the invention is in no way limited to the details of the illustrated arrangements but changes and modifications may be made without departing from the scope of the appended claims.

I claim:

1. A cross-flow type internal combustion engine including cylinder block means having cylinder bore means, cylinder head means mounted on the cylinder block means to define combustion chamber means therein, intake port means formed in said cylinder head means at one side thereof and opening at one end to said combustion chamber means, exhaust port means formed in said cylinder head means at the other side thereof and opening to said combustion chamber means, said cylinder head means being formed with mating surface means where the other end of the intake port means is opened, intake manifold means attached to said cylinder head means and communicating with said intake port means, cooling medium jacket means formed in said cylinder head means for passing cooling medium therethrough, exhaust gas recirculating passage means formed in said cylinder head means adjacent to said intake port means and said jacket means, said exhaust gas recirculating passage means having one end opened to said exhaust port means and the other end opened at said mating surface means, expansion chamber means formed in said exhaust gas recirculating passage means adjacent to said intake port means and said jacket means.

2. An engine in accordance with claim 1 in which said water jacket means extends at least partially between said expansion chamber means and said cylinder block means.

3. An engine in accordance with claim 2 which is of a multiple cylinder type and in which said cylinder block means includes a plurality of cylinder bores and a plurality of combustion chambers are defined, said intake port means including a plurality of intake ports formed in said cylinder head means, said expansion chamber means being formed between two adjacent intake ports.

4. An engine in accordance with claim 1 which is of a multiple cylinder type including a plurality of exhaust ports leading from a plurality of combustion chambers, said exhaust gas recirculating passage means being opened to at least two exhaust ports.

5. An engine in accordance with claim 4 in which said exhaust gas recirculating passage means is opened to at least two exhaust ports leading from the combustion chambers wherein combustion does not take place successively.

6. An engine in accordance with claim 4 which is of a four cylinder type and in which said exhaust gas recirculating passage means is opened to Nos. 2 and 3 cylinders.

7. An engine in accordance with claim 1 which further includes exhaust gas passage means formed in said intake manifold means and having one end connected with said other end of the exhaust gas recirculating passage means.

* * * * *